US006067980A

United States Patent [19]

Kahlke et al.

[11] Patent Number: 6,067,980

[45] Date of Patent: May 30, 2000

[54] GAS COOKING APPLIANCE

[75] Inventors: Michael Kahlke, Bingen; Bernd Schultheis, Schwabenheim; Martin Taplan, Reinhbollen; Stefan Hubert, Bubenheim, all of Germany

[73] Assignee: Schott Glaswerke, Mainz, Germany

[21] Appl. No.: 09/015,294

[22] Filed: Jan. 29, 1998

[30] Foreign Application Priority Data

Jan. 30, 1997 [DE] Germany ..... 197033016

[51] Int. Cl.[7] ..... F24C 15/10

[52] U.S. Cl. ..... 126/214 R; 126/39 H; 126/39 J

[58] Field of Search ..... 126/39 H, 39 J, 126/39 N, 39 F, 299 R, 299 D, 21 R, 41 R, 214 R, 214 A

[56] References Cited

U.S. PATENT DOCUMENTS

| | | | |
|---|---|---|---|
| 2,611,358 | 9/1952 | Taylor | 126/214 R |
| 4,951,646 | 8/1990 | Diekmann et al. | 126/39 J |
| 5,139,007 | 8/1992 | Martinez | 126/39 J |
| 5,357,079 | 10/1994 | Henry et al. | 219/453 |
| 5,509,403 | 4/1996 | Kahlke et al. | 126/39 E |
| 5,549,100 | 8/1996 | Heisner et al. | 126/39 J |
| 5,653,219 | 8/1997 | Taplan et al. | 126/39 H |

FOREIGN PATENT DOCUMENTS

| | | | |
|---|---|---|---|
| 43 26 945 C2 | 2/1995 | Germany . | |
| 295 00 051 U | 4/1995 | Germany . | |
| 44 33 334 C2 | 4/1995 | Germany . | |
| 195 05 469 C1 | 2/1996 | Germany . | |
| 2267750 | 12/1993 | United Kingdom | 126/214 R |

*Primary Examiner*—James C. Yeung
*Assistant Examiner*—Sara Clarke
*Attorney, Agent, or Firm*—Millen, White, Zelano & Branigan

[57] ABSTRACT

Gas cooking appliances having glass or glass-ceramic plates for cooking surfaces also having gas-radiation burners that are positioned below the plate or atmospheric burners that are recessed in the plate. With gas radiation burners, care must be taken to ensure a thermally advantageous discharge of exhaust gases that are produced and with atmospheric burners, care must be taken to ensure an adequate supply of primary air. Accordingly, the glass or glass-ceramic plate forming the cooking surface is partially bent out of the cooking surface plane to form an adhesive-free exhaust air duct or fresh air opening in the bent area. The exhaust air duct and fresh air opening are free of ventilation lattices.

27 Claims, 6 Drawing Sheets

GAS COOKING APPLIANCE

FIELD OF THE INVENTION

The invention relates to a gas cooking appliance with at least one gas-radiation or atmospheric burner and a glass or glass-ceramic plate as a cooking surface, which is attached to a cooking area frame, and with an opening and an associated guideway for exhaust air in gas-radiation burners or for fresh air in atmospheric burners.

BACKGROUND OF THE INVENTION

Gas cooking appliances with a glass or glass-ceramic plate as a cooking surface are marketed in two versions. In one version, gas-radiation burners in which the gas that is fed in together with primary air is burned at the surface of a burner plate that is made of porous ceramic are provided for heating. One or more of such gas-radiation burners are arranged at a distance under a common glass-ceramic plate, which is glued in place in a cooking area frame. Here, each gas-radiation burner defines a cooking zone on the top side of the glass-ceramic plate. Below the glass-ceramic plate is also an insulating part that has recesses for the gas-radiation burner and exhaust air ducts for discharging hot exhaust gases from the individual burners, which end in a common elongated outlet that lies below the cooking area frame, which in this area has lattice-like ventilation slots for the discharge of hot exhaust air.

A gas cooking appliance of this version is described in DE 43 26 945 C2, incorporated herein by reference. This known gas cooking appliance has a fan that brings in air from the outside to the burner and in addition cools the exhaust gases via a bypass, as well as preventing elevated temperatures in the housing wall by a ventilation system that is installed on the outside walls, but the design of the exhaust air guideway requires that the hot exhaust gases first flow past the connecting point between the glass-ceramic plate and cooking area frame and only then be further mixed with cold air and pass through the outlet openings into the ventilation lattice. This leads to considerable thermal stress on the adhesive compound that is between the glass-ceramic plate and the cooking area frame and that also must be present in the area of the ventilation lattice for overflow protection. Baffles or the like could reduce the thermal stress, but this would result in additional installation expense.

It is judged a further drawback that ventilation lattices are not especially easy to clean, tend to discolor, and also detract from the overall appearance of the gas cooking appliance.

In the second version of gas cooking appliances with a glass or glass-ceramic plate as a cooking surface, atmospheric burners, i.e., burners with open flames, are integrated in corresponding openings in the glass or glass-ceramic plate. While in the first version with gas-radiation burners the exhaust air requires a special guideway, the second version with atmospheric burners depends on a supply of primary air, i.e., fresh air. In upright ranges according to the second version, primary air is supplied in a known way via ventilation slots, i.e., via corresponding ventilation lattices in the range or counter guard area. This concept has the drawback that the ventilation lattices are problematical with respect to cleaning, as already mentioned above. In the case of recessed cooking areas according to the second version, as, for example, DE 195 05 469 C1, incorporated herein by reference, has disclosed, however, supplying primary air via corresponding recesses in the bottom plate is at the least not readily possible. Therefore, in the known case on the cooking surface plane, i.e., either between the glass-ceramic plate and the associated frame structure or the bent control panel, an elongated opening is provided for the air supply, which is covered in the shape of a hood. This design of the primary air supply has the drawback that only a relatively small overflow volume can be collected, so that there exists the danger that spilled food may pass through the fresh air intake opening into the interior of the recess and contaminate the electronic/electric components that are contained within. Even in the case where the cooking surface is maintained and cleaned, however, the danger of the entry of liquids, e.g., cleaning materials, exists, with the corresponding adverse consequences.

SUMMARY OF THE INVENTION

The object of the invention in the above-indicated gas cooking appliance is to design the opening and the associated guideway for, on the one hand, the exhaust air from gas-radiation burners in a way that poses no heat problems because it is free of adhesive compound and is still protected from overflow, and, on the other hand, for fresh air in atmospheric burners that are reliably protected from spilled food and cleaning materials, as well as being generally easy to clean.

This object is achieved according to the invention because the glass or glass-ceramic plate of the cooking surface is partially bent out of the cooking surface plane, the opening with a guideway for exhaust air or for fresh air is designed lattice-free in the bent area at some distance to the cooking surface plane, and at least in the design of the opening and the guideway for the exhaust air, no adhesive compound is provided between the glass or glass-ceramic plate and the cooking area frame.

With the design according to the invention, the area of the glass/glass-ceramic surface with the opening for fresh air or exhaust air is just as easy to clean as the cooking surface itself In this case, the bending of the cooking surface offers effective overflow protection, as well as protection against cleaning liquids or the like getting into the fresh air or exhaust air opening. Since there is no adhesive compound in the area of the exhaust air opening and the materials in this area can be subject to heavy thermal stress in any case, the exhaust air opening according to the invention poses no heat problems.

The partial bending of a glass-ceramic plate of the cooking surface in gas cooking appliances has been basically disclosed by DE 43 33 334 C2, incorporated herein by reference. In the known case, the bent area forms a counter guard with openings for controls and displays. Openings for fresh air or exhaust air are not made by the bent area since it, like the cooking surface portion itself, is encased tightly in the cooking area frame.

In connection with induction cooking appliances with a glass-ceramic cooking surface, it is also known from DE-U-295 00 051.1 C2, incorporated herein by reference, to bend the glass-ceramic plate that forms the cooking surface with the formation of an air drain between it and the cooking area frame in the rear portion. In this case, the bent area is connected in a cushioned manner to the cooking area frame by a silicone coating.

Such a design of the air drain as an exhaust air opening for a gas cooking appliance with gas-radiation burners would be subject to excessive thermal stress because of the silicone coatings, however, and thus be of no use in practice. It is limited to glass-ceramic cooking areas with induction rings to remove heat buildup from below the glass-ceramic plate and is not suitable for drawing off very hot combustion gases, as in the case of gas burner rings.

According to a first embodiment of the invention, the glass or glass-ceramic plate is bent upward from the cooking surface plane. This embodiment offers special advantages when the opening is designed to remove hot exhaust air gases since it supports natural convection. This embodiment also offers good overflow protection.

According to another further development of the invention, the glass or glass-ceramic plate is bent downward from the cooking surface plane. Such an embodiment is suitably used for an opening to feed fresh air to open gas burners since rising cooler air is drawn in.

For the shaping of the bent area, a number of options are available that are adapted to the necessary air throughput and production options, but also decisively to the design. The bending edge of the area, and thus the area itself, can extend over an entire side of the cooking surface. However, embodiments of the invention are also conceivable in which the bending edge of the bent area extends over only a portion of the side of the cooking surface. Here, the bending edge and thus the bent area can be designed concentrically or eccentrically, depending on the desired design.

A number of further developments of the invention are also possible for the design of the opening and the associated guideway for fresh air or exhaust air. The gas cooking appliance can thus be designed in such a way that between the edge of the bent area and an edge of the appliance, an elongated opening is formed with a guideway for the discharge of exhaust air or the intake of fresh air.

In this case, the edge of the appliance can be the cooking area frame, an area of the appliance housing, or an area of an adjacent cooking surface in the case of combination appliances.

As an alternative to this, according to another embodiment of the invention, at least one recess is designed inside the bent area as an outlet opening for exhaust air or as an intake opening for fresh air, whereby the cooking area frame encompasses the edge of the bent area. In this way, the design requirements and tastes also play a decisive role. For this purpose, the invention makes possible with great advantage a broad array of possibilities. Thus, e.g., several circular recesses that are arranged in a line can be provided. Also aesthetically appealing is a further development of the cooking appliance according to the invention where a concentric linear recess is provided, whose depth extends only over a portion of the depth of the bent area.

In this case, special advantages with respect to the exhaust air guideway are ensured when, according to a further development of this concept, the glass or glass-ceramic plate is bent over two bending edges in such a way that the second bent area extends as a parallel surface to the cooking surface and houses the recess.

BRIEF DESCRIPTION OF THE DRAWINGS

Additional embodiments, possible applications, and advantages of the invention are indicated by the description of the embodiments that are depicted in the drawings.

DETAILED DESCRIPTION

Figure 1:
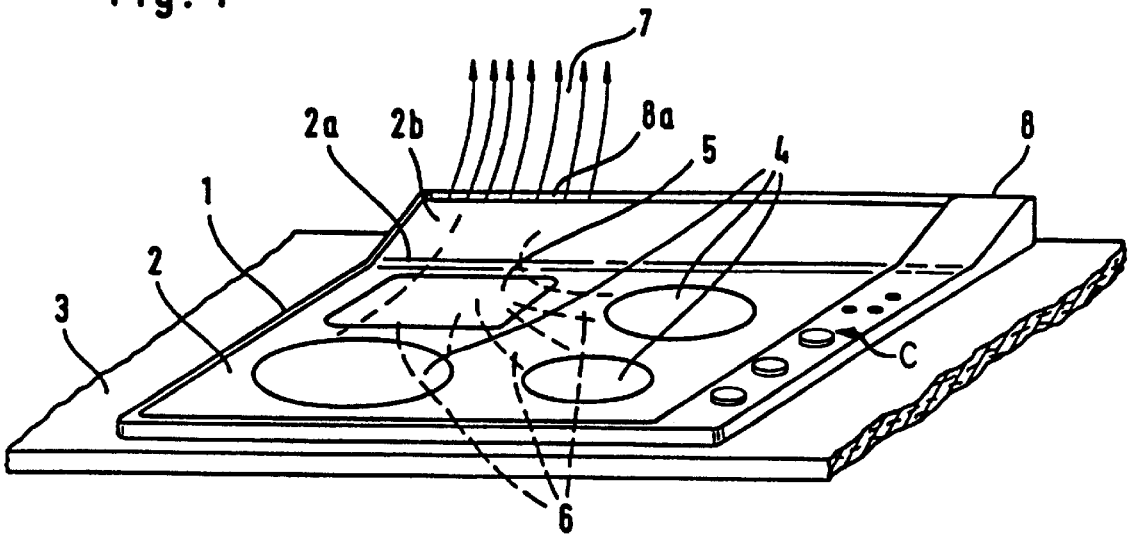
FIG. 1 shows, in a diagrammatic perspective view, a gas cooking appliance with gas-radiation burners and an exhaust gas opening that is designed according to the invention.

In a diagrammatic, perspective view, FIG. 1 shows a gas cooking appliance 1 of the first version, installed in a sill plate 3. The gas cooking appliance has a glass-ceramic plate 2 as a cooking surface, which is attached to a cooking area frame 8, generally by gluing with a silicone adhesive. In the embodiment according to FIG. 1, the gas cooking appliance has three cooking zones 4 that are heated by means of gas-radiation burners (not shown) that are arranged under the glass-ceramic plate. As indicated overall by the above-cited DE 43 26 945 C2, an insulating part 9, which can also be seen partially from the cutaway view of FIG. 2 of this application, is provided below glass-ceramic plate 2 to provide a gap therebetween. This insulating part 9 has recesses (not shown) for the gas-radiation burners, but also exhaust gas ducts 6 for discharging exhaust gases from the individual gas-radiation burners. Exhaust gas ducts 6 are joined below a cooking-surface zone 5 that is often used for boiling off and finally end in an exhaust gas opening 8*a* that is designed according to the invention. To form exhaust gas opening 8*a*, cooking surface 2 is beveled upward around a line 2*a* in the rear part in such a way that unitary beveled portion 2*b* projects upward like a panel. There is a back wall provided by the frame 8 which is in FIG. 1 spaced from the rear edge of the bent area 2*b*.

Figure 10:
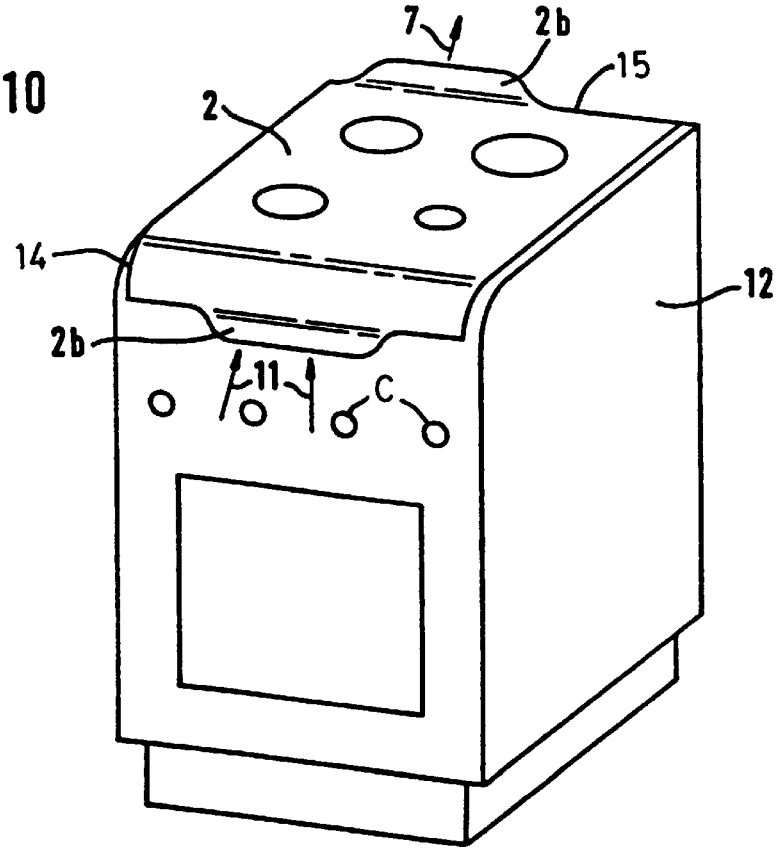
FIG. 10 is a frontal, concentric glass-ceramic plate that is bent downward, forming a frontal fresh air opening that simultaneously has a rear laterally partially strongly bent area with the formation of an exhaust air opening, used in an upright range, which can be installed both with gas-radiation burners and with atmospheric burners.

Here, cooking surface 2 is glued in cooking surface-frame housing 8 in such a way that a slot-shaped, adhesive-free opening 8*a* is formed as an outlet opening for hot exhaust gases 7 at the rear of the cooking surface 2 and gas cooking appliance 1. The control knobs C are shown at the right side of the cooking surface but may be at the front of the cooking surface as is shown in FIG. 10.

According to the corresponding cutaway view, hot exhaust gases 7*a* of several hundred degrees flow into exhaust gas ducts 6 that are made from insulating elements 9 to outlet opening 8*a* and, shortly before this, are mixed with cold air 7*b* that a fan produces, so that overall a considerably colder exhaust gas stream 7 leaves the gas cooking appliance.

To protect the bent cooking surface edge, optionally a metal contour 8*b* can be mounted mechanically. This contour must not be glued with silicone since in this case it would not seal. The overflow protection in this design is ensured by the portion of cooking surface 2*b* that is beveled upward.

The advantage of the design of exhaust gas opening 8*a* lies in the fact that, on the one hand, no adhesive compounds are located in the hot exhaust gas stream and in that overflow protection is automatically ensured by the shape of the cooking surfaces. In addition, the ventilation lattices are omitted from the metal frame, which, on the one hand, have a negative impact on the overall design, and, on the other hand, impede cleaning.

This type of design according to the invention can also be used for gas cooking appliances of the second version with atmospheric burners. In this case, opening 8*a* is used as a fresh air opening for primary air.

Figure 3:
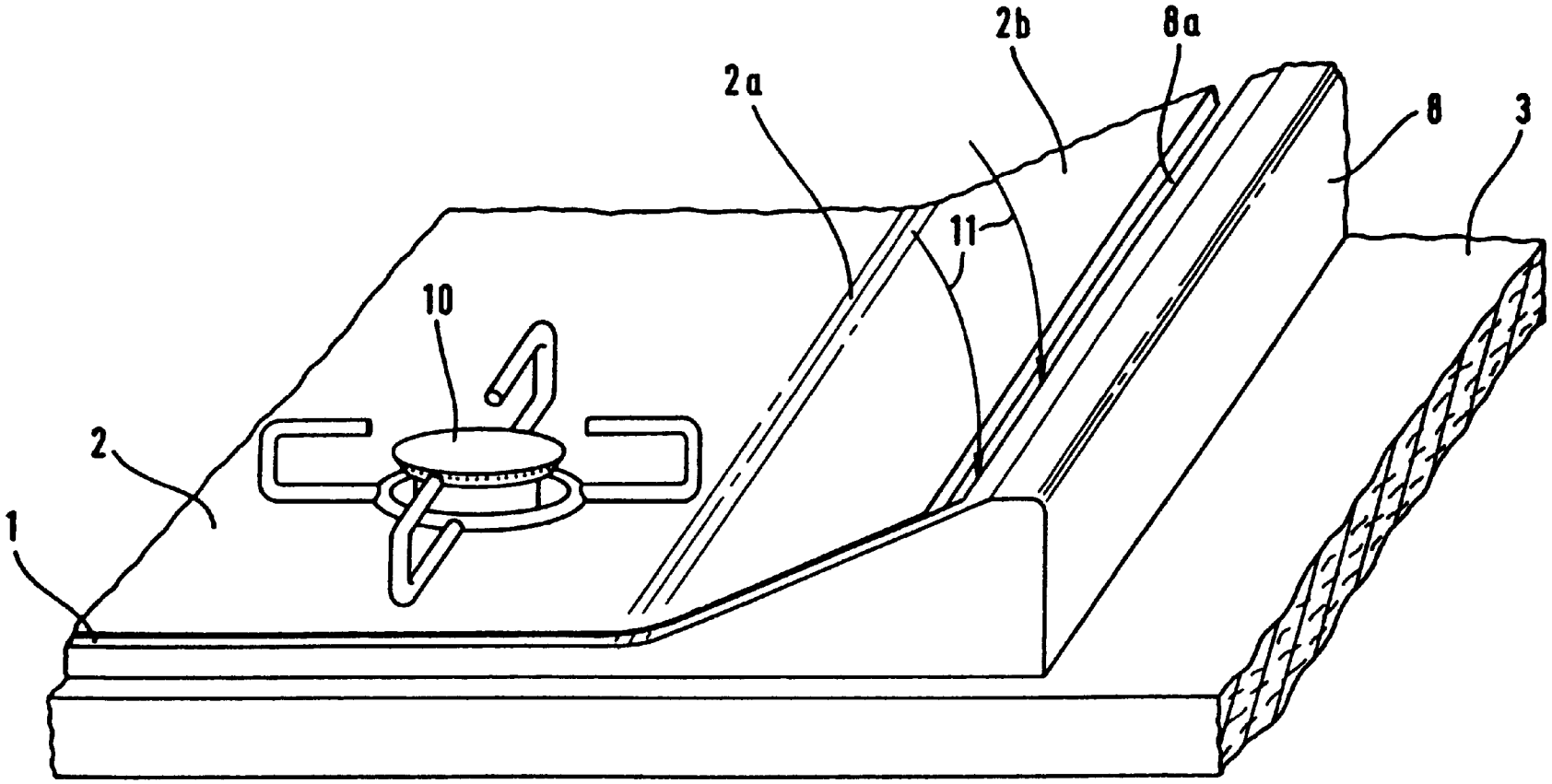
FIG. 3 shows a gas cooking appliance that corresponds to FIGS. 1 and 2, but with atmospheric burners and a fresh air opening that is designed according to the invention.

FIG. 3 shows a diagram of such a gas cooking appliance 1 with an atmospheric burner 10, which is recessed in the conventional way in glass-ceramic plate 2. Generally, a cooking area has three to four such open burners 10.

Glass-ceramic plate 2 is glued into cooking area frame housing 8, whereby the gas cooking appliance itself is installed in sill plate 3. Unlike in FIG. 1, only to indicate the possible variations, bending edge 2*a* with bent area 2*b* lies on the (right) side of cooking surface 2. In this case, as in FIG. 1, a slot-shaped opening 8*a* is made between the upper edge of bent area 2*b* and frame 8, via which fresh air or primary air 11 flows into the cooking area.

As in FIG. 1, bending edge 2*a* can, of course, also be arranged on the rear side or on the left side of the cooking surface. Which alternative is selected depends on the design and the appliances that are arranged in the vicinity of the gas cooking appliance in sill plate 3.

Figure 2:
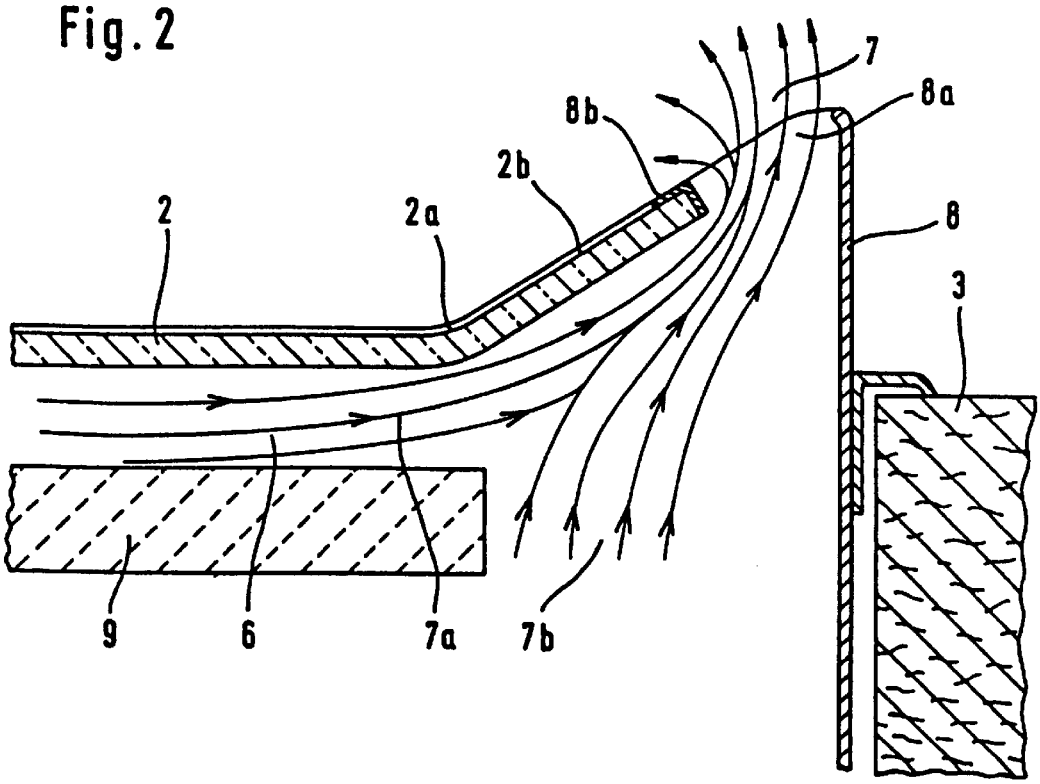
FIG. 2 shows a cutaway of FIG. 1, on an enlarged scale, with a sectional view of the exhaust gas guideway.
Figure 4:
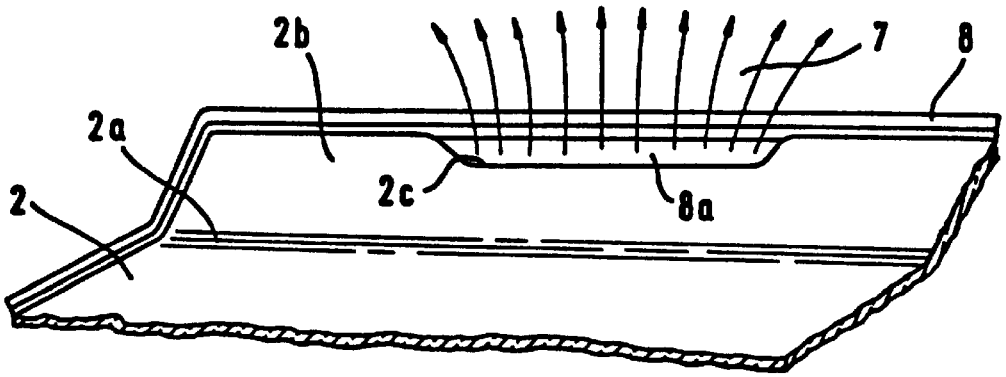
FIG. 4, in a view in dashed lines, is a cutaway of the back bent portion of the cooking surface with a concentric recess in the bent area for forming a fresh air or exhaust air opening.

FIG. 4 shows another embodiment of the invention with respect to the design of the opening for fresh air or exhaust air, whereby the case of exhaust air is depicted. Parts that are identical to those according to FIGS. 1–3 are given the same reference numbers. In FIG. 4, beveled area 2*b* has a partial recess 2*c* that forms exhaust gas opening 8*a*, through which cooled exhaust gases 7 flow out. In addition, the upper edge of bent area 2*b* is embedded in cooking area frame 8.

Figure 5:
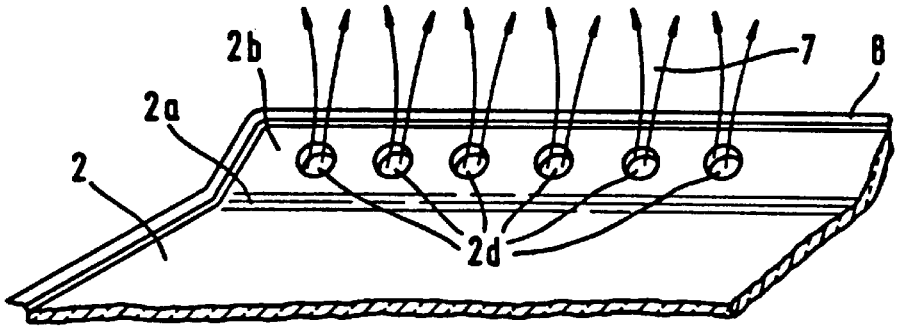
FIG. 5 in a view in dashed lines, is a cutaway of the back bent portion of the cooking surface with circular recesses that form the fresh air or exhaust air openings and that are arranged in a line in the bent portion.

In the case of FIG. 4, opening 8*a* is thus not formed by a space (gap) in other appliance parts, as in FIGS. 1–3, but by a recess in bent area 2*b* itself. FIG. 5 shows another embodiment according to this principle. Accordingly, bent area 2*b* has recesses 2*d* that are arranged like a line, through which the exhaust air or fresh air flows. The circular recess is indicated only by way of example. If design considerations so dictate, other geometric configurations can also be used. The line-like arrangement is also given only by way of example. Recesses 2*d* can also be arranged in an offset pattern, for example. Recesses 2*d* are invariably to be arranged in such a way that they are sufficiently far from the cooking surface plane, thus ensuring overflow protection. Otherwise, the upper edge of bent area 2*b* is completely embedded in cooking area frame 8; this stresses an overall closed impression.

Figure 5A:
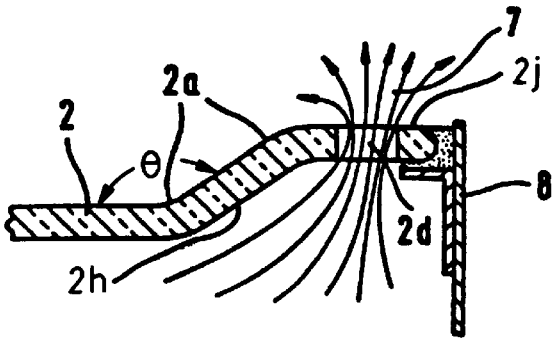
FIG. 5*a* is a modification of the design according to FIG. 5, in which the glass-ceramic cooking surface plate is bent over two edges, and the recesses are designed in the horizontal, second bent area.

FIG. 5*a* shows an arrangement similar to that of FIG. 5. In this case, glass-ceramic plate 2 of the cooking surface is bent over two bending edges 2*a*, in such a way that the area 2*b* with recesses 2*d* is raised by a portion 2*h* that extends at an obtuse angle θ relative to the cooking surface to extend horizontal plane and is arranged plane parallel to the cooking surface. In this embodiment, the exhaust gas flows vertically upward, which has an advantageous effect for catching exhaust gases in the exhaust hoods that are usually present in the kitchen. Also advantageously, the exhaust gases cannot gradually discolor any wall parts of the kitchen appliance.

Figure 6:
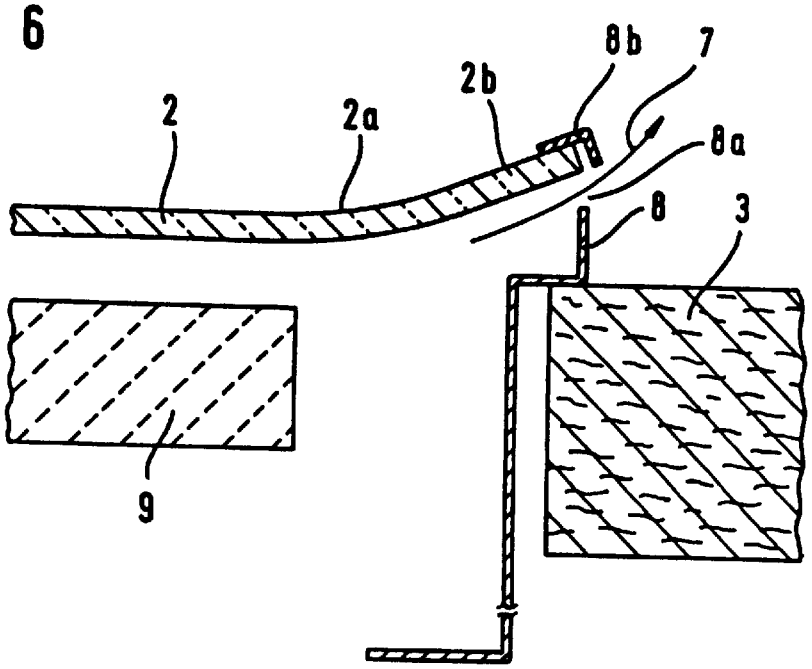
FIG. 6 is an arrangement corresponding to FIG. 2, but with an exhaust air opening that is made at the back.

FIG. 6 shows an arrangement analogous to that according to FIG. 2, whereby, however, outlet opening 8*a* is not made, as in the case of FIG. 2, between the upper edge of the bent area that is protected by a contour 8*b* and an elevation of cooking area frame 8, but between this edge and a lowered side of frame 8, so that exhaust air 7 flows toward the rear.

Figure 7:
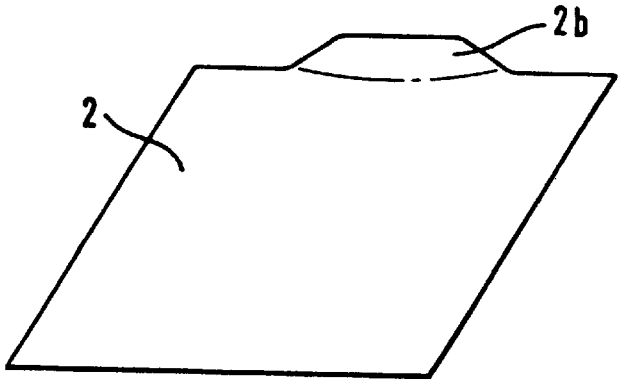
FIG. 7 is a rear concentric, partially strongly bent glass-ceramic plate of the cooking surface.
Figure 8:
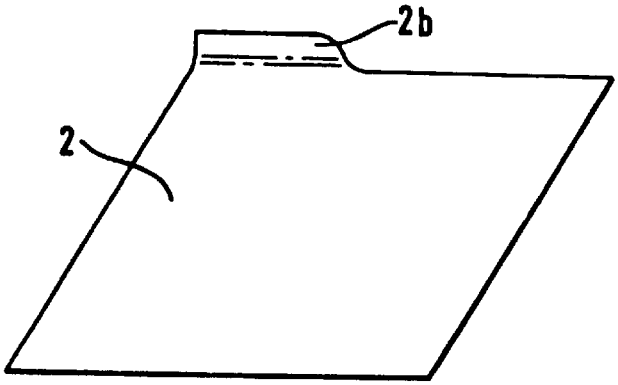
FIG. 8 is a rear, laterally partially strongly bent glass-ceramic plate of the cooking surface.

FIG. 7 shows a partial area 2*b* that is formed bent concentrically toward the rear as a ventilation duct (fresh air or exhaust air), in contrast to the preceding embodiments with a bent area 2*b*, which extends completely over one side of the cooking surface. In this case, partial area 2*b* also does not have to be located concentrically to the cooking surface side, as in FIG. 7; it can also be molded on eccentrically, i.e., on one side, as depicted in FIG. 8, specifically, relative to the cooking surface, either behind or to the right or else to the left.

Figure 9:
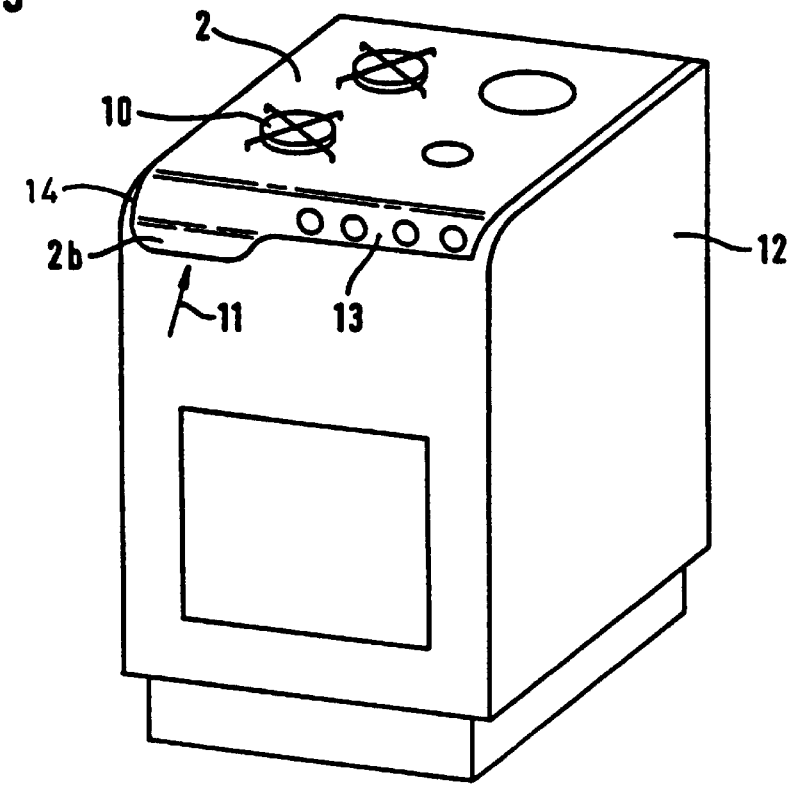
FIG. 9 is a frontal and eccentric glass-ceramic plate that is partially bent downward in an upright range for atmospheric burners, forming a frontal opening for fresh air.

FIGS. 9 and 10 also show widely differing possible variations for the design of bent area 2*b* in the example of an upright range 12 at front and rear edge areas 14 and 15.

In upright range 12 according to FIG. 9, which is designed with an integrated switch part 13 as a gas cooking appliance with open gas burners 10 (as in FIG. 3), glass-ceramic plate 2 is bent downward toward the front, adjacent edge 14 whereby the opening for fresh air 11 is made in area 2*b*.

Upright range 12 according to FIG. 10 can be designed as desired as a gas cooking appliance with gas-radiation burners or as an appliance with atmospheric burners. The glass-ceramic plate is therefore partially bent both forward adjacent from edge 15 and toward the rear at rear edge 5, with the formation of an area 2*b* in each case. In this case, front area 2*b* forms the intake opening for the primary-fresh air in the case of open burners; conversely, rear partial bend 2*b* forms the opening for the discharge of exhaust air 7 in the case where upright range 12 is equipped with gas-radiation burners.

Figure 11:
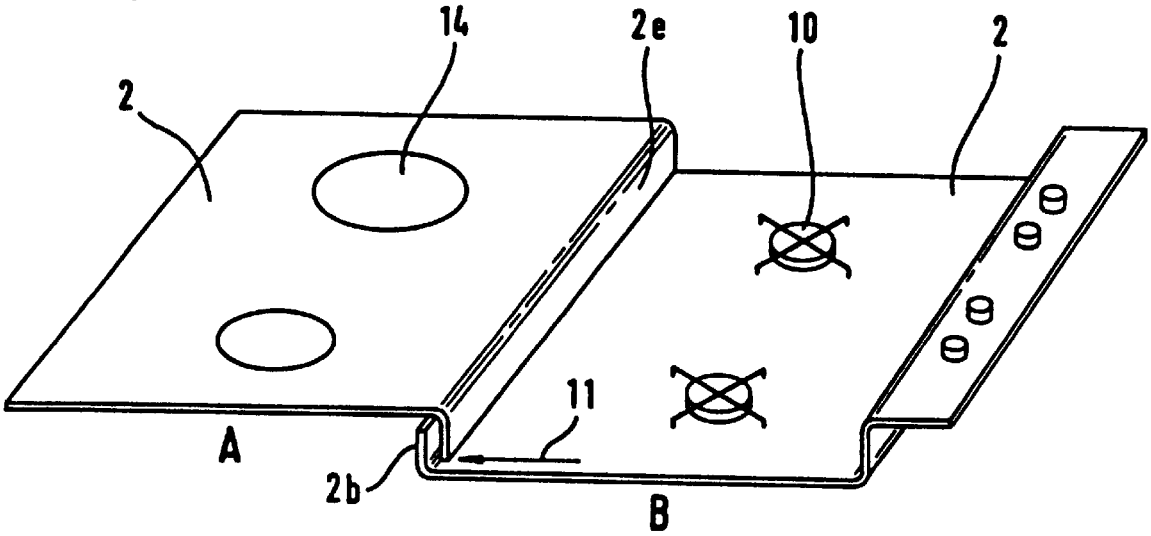
FIG. 11 is a recessed tray with an electric part and an adjoining gas portion that is recessed with atmospheric burners, in which the corresponding glass-ceramic plates that are arranged some distance away have two rectangular bends with the formation of a fresh air opening for the gas portion.
Figure 12:
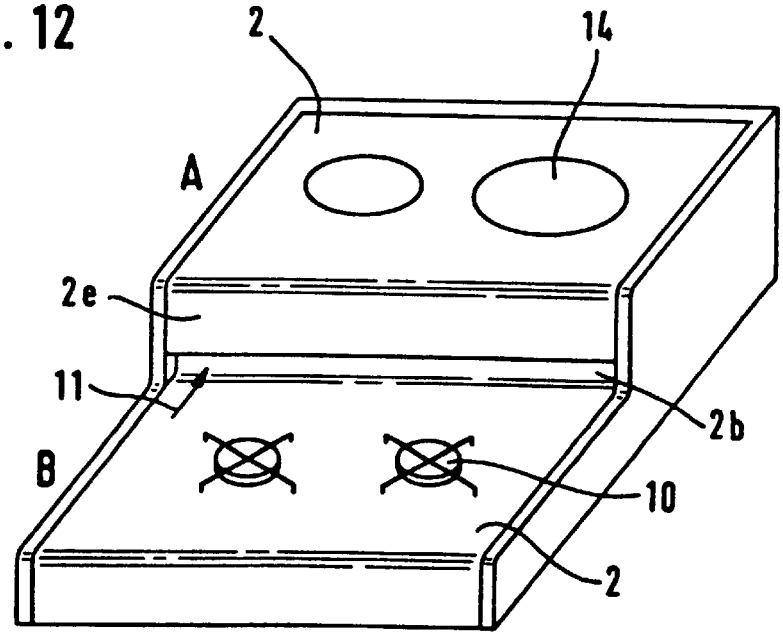
FIG. 12 is an appliance combination according to FIG. 11, designed as a cooking table.

In the previous embodiments, the opening for exhaust air and fresh air was formed between the upper edge of the bend and a cooking area or range device part. In FIGS. 11 and 12, embodiments are depicted in which the opening is made in a part of another type of cooking appliance.

FIG. 11 shows a recessed tray with glass-ceramic cooking surfaces, composed of an electric part A and a gas part B. Glass-ceramic plate 2 of electric part A has cooking zones 14 and a lip 2*e* that is bent downward by 90° and has a lower edge. Glass-ceramic plate 2 of gas part B, which is lower than electric part A, has open burners 10 and a rectangular lip 2*b* that is bent upward and has an upper edge, whereby a certain distance is left between bent areas 2*b* and 2*e* that acts as an intake opening for fresh air 11 in gas burner part B.

In a corresponding way, FIG. 12 shows a cooking table that is composed of an electric part A with a glass-ceramic plate 2, which has a rectangular beveled area 2*e* and cooking zones 14, as well as a gas part B, which is lower than electric part A, with a glass-ceramic plate 2, which has a rectangular partial area 2*b* that is bent upward (covered partially by beveled edge 2*e* in the drawing), as well as atmospheric gas burners 10. As in the case of FIG. 11, two bent areas 2*e* and 2*b* that are arranged some distance apart also form an opening here with a guideway for fresh air 11 to gas part B.

The entire disclosure of all applications, patents and publications, cited above and below, and of corresponding German application No. 197 03 301.6, filed Jan. 30, 1997, is hereby incorporated by reference.

From the foregoing examples, one skilled in the art can easily ascertain the essential characteristics of this invention and, without departing from the spirit and scope thereof, can make various changes and modifications of the invention to adapt it to various usages and conditions.

What is claimed is:

1. A gas cooking appliance comprising:

at least one gas-radiation or atmospheric gas burner;

a glass or glass-ceramic plate having a plane defining a planar cooking surface, which plate is attached to a cooking area frame, the plate being partially bent out of the plane of the planar cooking surface to form a bent area which is unitary with the planar cooking surface, and an associated guideway with an outlet opening for exhaust air in the case of gas-radiation burners or at least one inlet opening for fresh air in the case of atmospheric burners, the guideway being free of ventilation lattices in the bent area and the opening being spaced a distance from the planar cooking surface, and when used as an exhaust air opening, the juncture between the glass or glass-ceramic plate and cooking area frame being free from adhesive.

2. A gas cooking appliance according to claim 1, wherein glass or glass-ceramic plate is bent upward from the cooking surface plane.

3. A gas cooking appliance according to claim 2, wherein at least one recess is through the bent area to provide an outlet opening for exhaust air or to provide an intake opening for fresh air, and wherein the cooking area frame engages the edge of the bent area.

4. A gas cooking appliance according to claim 3, wherein the bent area has several circular recesses arranged in a line.

5. A gas cooking appliance according to claim 3, wherein a linear recess having a width extending only over a portion of the width of the bent area, is provided.

6. A gas cooking appliance according to claim 3, wherein the glass or glass-ceramic plate is bent at two bending junctures, with the second bent area extending substantially parallel to the cooking surface and having the recesses therethrough.

7. A gas cooking appliance according to claim 1, wherein glass or glass-ceramic plate is bent downward from the cooking surface plane.

8. A gas cooking appliance according to claim 1, wherein the bent area has a bending juncture with the cooking surface which extends along the entire length of the cooking surface.

9. A gas cooking appliance according to claim 1, wherein the bending juncture of the bent area extends over only a portion of one side of the cooking surface.

10. A gas cooking appliance according to claim 9, wherein bending juncture is centered with respect to the plate.

11. A gas cooking appliance according to claim 9, wherein bending juncture is laterally off center with respect to the plate.

12. A gas cooking appliance according to claim 1, wherein between the bending juncture and an of the cooking appliance edge, there is an elongated opening with a guideway for the discharge of exhaust air or the intake of fresh air.

13. A gas cooking appliance according to claim 1, further having a substantially horizontal top cooking surface facing what is to be cooked by the burners on the plate, the plate further having the bent area unitary with the horizontal top surface and having a rear edge, the bent area being disposed at an obtuse angle to the horizontal top surface;

an insulation plate disposed beneath the plate in spaced relation thereto with the guideway therebetween, the guideway being unobstructed and free of ventilation lattices, as well as being free of adhesive if the guideway is used as an exhaust gas opening; and a back wall positioned in spaced relation to the insulation plate and to the edge of the bent area to provide the opening through the cooking appliance, whereby a passage is provided for exhaust air if the burners are gas radiation burners.

14. A gas cooking appliance according to claim 13, wherein the bent area has no openings therethrough.

15. A gas cooking appliance according to claim 14, wherein the bent area extends only a portion of the width of the plate.

16. A gas cooking appliance according to claim 15, wherein the bent area is centrally located.

17. A gas cooking appliance according to claim 15, wherein the bent area is disposed adjacent to a side edge of the plate.

18. A gas cooking appliance according to claim 14, wherein the rear wall is a portion of a cooking surface-frame housing.

19. A gas cooking appliance according to claim 14, wherein the rear wall terminates below the edge of the bent portion, wherein air exiting the opening has a substantial horizontal component.

20. A gas cooking appliance according to claim 14, wherein the rear wall terminates behind the edge, wherein air exits the opening in a vertical direction.

21. A gas cooking appliance according to claim 14, wherein the rear edge of the bent area is recessed to provide the opening with remaining portions of the bent area meeting the back wall.

22. A gas cooking appliance of claim 13, wherein the plate has a second bent area on a front edge thereof providing an inlet for air flowing through the gap.

23. The gas cooking appliance of claim 22, wherein the second bent area bends downward and extends in the opposite direction of the first bent area.

24. A gas cooking appliance according to claim 1 comprising:

an insulation plate disposed beneath the plate in spaced relation thereto to provide a gap therebetween, which gap defines the guideway;

the bent area having an edge and a back wall joining the edge of the bent area; and a plurality of openings through the bent area to provide outlet passage for exhaust air if the burners are gas radiation burners or an inlet for fresh air, if the burners are atmospheric burners.

25. The gas cooking appliance of claim 24, wherein the openings are an array of round holes.

26. The gas cooking appliance of claim 24, wherein the bent area for a first portion of its extent extends at an obtuse angle and for a second portion of its extent extends substantially horizontal 14, and wherein the openings are through the second portion of its extent.

27. The gas cooking appliance of claim 26, wherein the openings are arranged in a line.

* * * * *